United States Patent [19]

Roberts

[11] Patent Number: 4,637,230

[45] Date of Patent: Jan. 20, 1987

[54] CLOTHES WASHING MACHINE

[75] Inventor: Gerald L. Roberts, Louisville, Ky.

[73] Assignee: General Electric Company, Louisville, Ky.

[21] Appl. No.: 742,047

[22] Filed: Jun. 6, 1985

[51] Int. Cl.[4] ..... D06F 31/00

[52] U.S. Cl. ..... 68/4; 68/18 FA; 68/27

[58] Field of Search ..... 68/4, 18 FA, 23.4, 27

[56] References Cited

U.S. PATENT DOCUMENTS

| | | | |
|---|---|---|---|
| 3,014,358 | 12/1961 | Bochan | 68/4 |
| 3,091,107 | 5/1963 | Rhodes | 68/4 |
| 3,324,688 | 6/1967 | Hubbard | 68/4 |
| 3,481,162 | 12/1969 | Ziegler | 68/4 |
| 3,575,020 | 1/1969 | Hubbard | 68/4 |
| 4,175,409 | 11/1979 | Morey | 68/4 |

*Primary Examiner*—Philip R. Coe

*Attorney, Agent, or Firm*—Frank P. Giacalone; Radford M. Reams

[57] ABSTRACT

This invention relates to automatic clothes washing machines, and more particularly to an improved structure in such machines for affecting the washing of very small loads of clothing in a high detergent concentration. The clothes washing machine has wash, rinse and spin extraction operations including an outer imperforate tub, an agitator, a first basket within the tub, a second smaller basket disposed within the first basket and positioned on the agitator for movement therewith. There is also a water supply for feeding water into the machine, drive system for operating the agitator to effect washing of clothes and for rotating the basket to centrifugally extract water from the clothes. Water is allowed to flow from the basket to the tub and then recirculated through a filter and into the baskets. The recirculation system is controlled wherein only a predetermined volume of water is transferred from the outer tub to the small basket by the recirculation system. This allows clothes placed in the small basket to be washed in a high detergent concentration relative to the predetermined volume of water in the small basket and independent of the amount of water in the tub and to then be rinsed during continuous recirculation of water from the outer tub. The improvement comprising a system whereby the controlled volume of water in the small basket is recirculated through the filter while at the same time removing heavy soil from the water.

3 Claims, 3 Drawing Figures

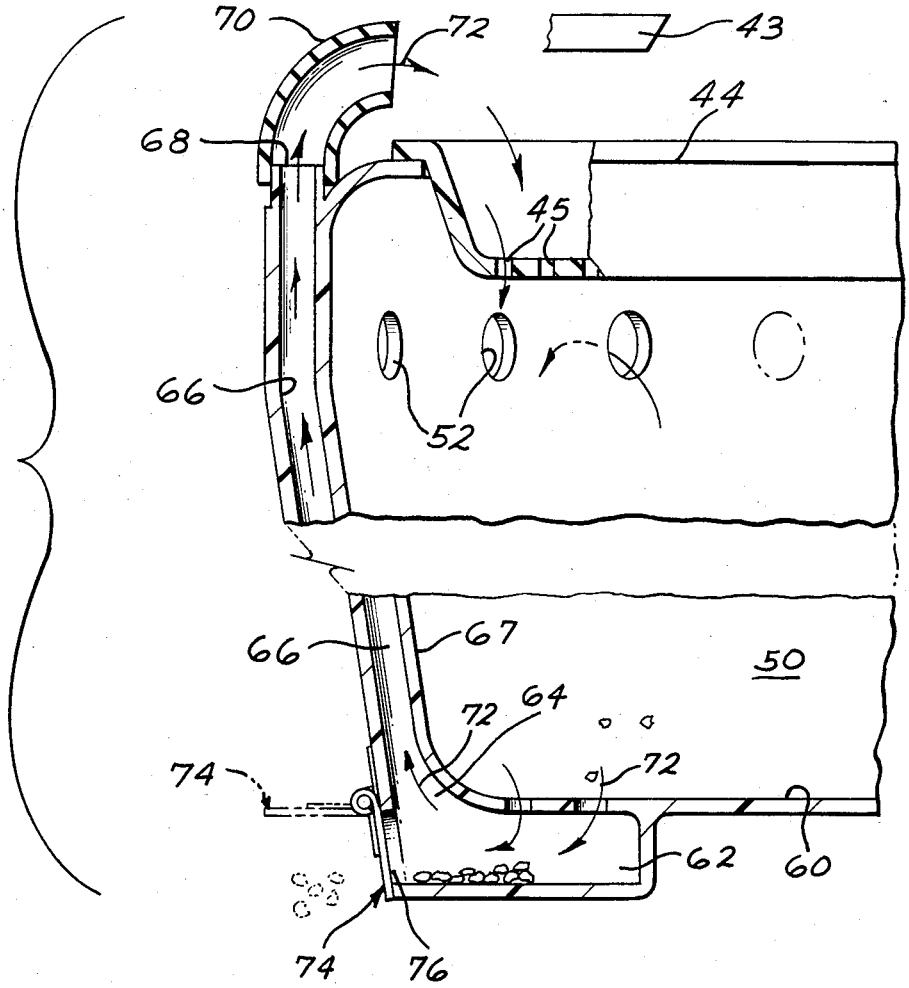
FIG. 2
FIG. 3
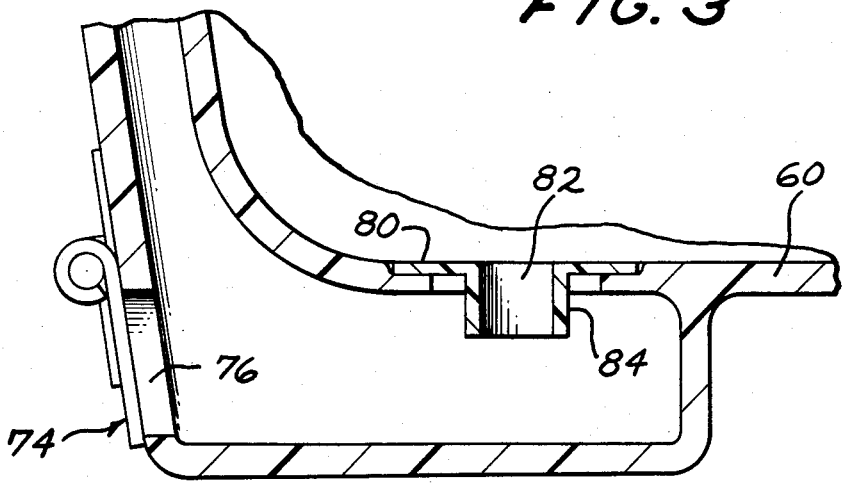

CLOTHES WASHING MACHINE

BACKGROUND OF THE INVENTION

The present invention relates to automatic clothes washing machines and more particularly to an improved structure in such machines for effecting the washing of relatively small loads of clothing and especially heavily soiled clothing in a high detergent concentration.

Automatic clothes washing machines customarily provide, in a clothes basket adapted to hold several pounds of clothes, a sequence of operations in order to wash, rinse and extract water from the clothes in the basket. The sequence ordinarily includes a water fill followed by a washing operation which, in a vertical axis type machine, is provided by an agitator movably arranged to oscillate within the basket; a first centrifugal liquid extraction operation in which the wash water is removed from the clothes by spinning the basket; another water fill followed by a rinsing operation in which the clothes are rinsed in clean water while the agitator is oscillated; and a final centrifugal liquid extraction operation in which the basket is spun to remove rinse water from the clothes. Machines having this type of cycle, or a variation thereof, generally produce highly satisfactory results in that the clothes come out properly cleaned and with a substantial part of the liquid removed.

In the case where clothes are extremely dirty or soiled with difficult to remove spots, they will emerge from the cycle of operations with at least some of those spots still visible. Generally, these exceptionally dirty clothes are a minority relative to a full wash. Thus, it would not be economical to add extra detergent to the full load of clothes just for the sake of cleaning an isolated heavily soiled item.

These types of clothes should be washed by themselves so that special treatment may be given to each item. One disadvantage which presents itself when very small loads are washed in the basket of a washing machine is that the amount of water required for washing a few items may be comparable to the amount of water used for washing several pounts of clothing. This, of course, represents an inefficient use of water with a resulting high cost of water and energy in heating the water in consideration of the results being obtained. Also, there is a correlary that the greater the quantity of water used, the greater the quantity of detergent needed in order to effect a proper detergent concentration in the water. This is even more critical in the instance of heavily soiled clothes which would require greater amounts of detergent. Considerations such as these have quite often led the owners of domestic clothes washing machines to do the washing of heavily soiled clothes by hand despite the availability of the machine.

One solution to this problem is the use of a small basket placed on the agitator inside the larger regular wash clothes basket. The motion of the agitator carries with it the small basket and provides a motion of the liquid in the basket which causes a suitable type washing action. This type of washing machine is described in U.S. Pat. No. 3,014,358 and is assigned to the assignee of the present invention. In the use of a small wash basket as described in U.S. Pat. No. 3,014,358 the clothes within the small basket are subjected to the same operational cycles as when the machine is used with a "normal" operation. The disadvantage in such a clothes washing cycle is that the water is continuously recirculated through the small basket. Accordingly, while the smaller basket has a relatively small volume the water level in the smaller basket is maintained by circulating all of the water in the machine machine through the smaller basket during the washing operation. This causes the detergent that is placed in the small basket to be diluted into the recirculating water in the machine.

Provision is made whereby during the washing cycle of operation only a predetermined volume of the fill water is circulated into the smaller basket during a timed recirculation cycle in which the recirculation of water is terminated prior to the wash cycle. While this relatively small volume of water is retained therein during the entire washing cycle of operation. This ability to confine a limited water volume allows for the attainment of a very high detergent concentration with the usage of reasonable and acceptable amount of detergent it also disables the lint removal ability since water is not circulating through the filter.

By the present invention means are provided whereby the washing action of the small basket causes a recirculation of the water therein through of filter.

Following this initial wash in a high detergent concentration the machine reverts to its "normal" cycle of operation; wherein all of the fill water in the machine is once again recirculated through the filter and small basket during the ensuing spin, rinse, and extraction cycles of operation.

SUMMARY OF THE INVENTION

By the present invention there is provided a vertical axis clothes washing machine comprising a liquid and clothes containing means including a relatively large substantially imperforate outer receptacle, and a relatively large perforated clothes receptacle positioned within the receptacle. An agitator extendes upwardly into the clothes receptacle. A drive system is provided for rotating the clothes receptacle and the agitator at a relatively high speed, including means for effecting a washing motion of the agitator. A water inlet means provides fresh water to the liquid and clothes containing means. Positioned on the agitator and movable therewith is a relatively small substantially imperforate basket which has overflow openings adjacent the top thereof. A primary recirculation system including a conduit connected between an inlet in the outer receptacle and an outlet positioned for supplying liquid to the small imperforate basket are arranged to pump liquid from the outer receptacle through the outlet means. A perforated filter pan is mounted on the agitator covering substantially the entire top of the imperforate basket. Further, the control means includes valve means in the conduit for allowing a predetermined amount of liquid to flow through the outlet means whereby clothes contained in the small imperforate basket are washed in the predetermined amount of liquid independently of liquid in the outer receptacle.

A secondary recirculation system for supplying water through the filter pan to the small basket by the washing motion of the agitator independent of the primary recirculation system.

DESCRIPTION OF DRAWINGS

FIG. 2 is an enlarged fragmentary view showing certain details of the present invention; and FIG. 3 is an enlarged fragmentary view showing another embodiment of a portion of the present invention.

DESCRIPTION OF THE PREFERRED EMBODIMENT

Figure 1:
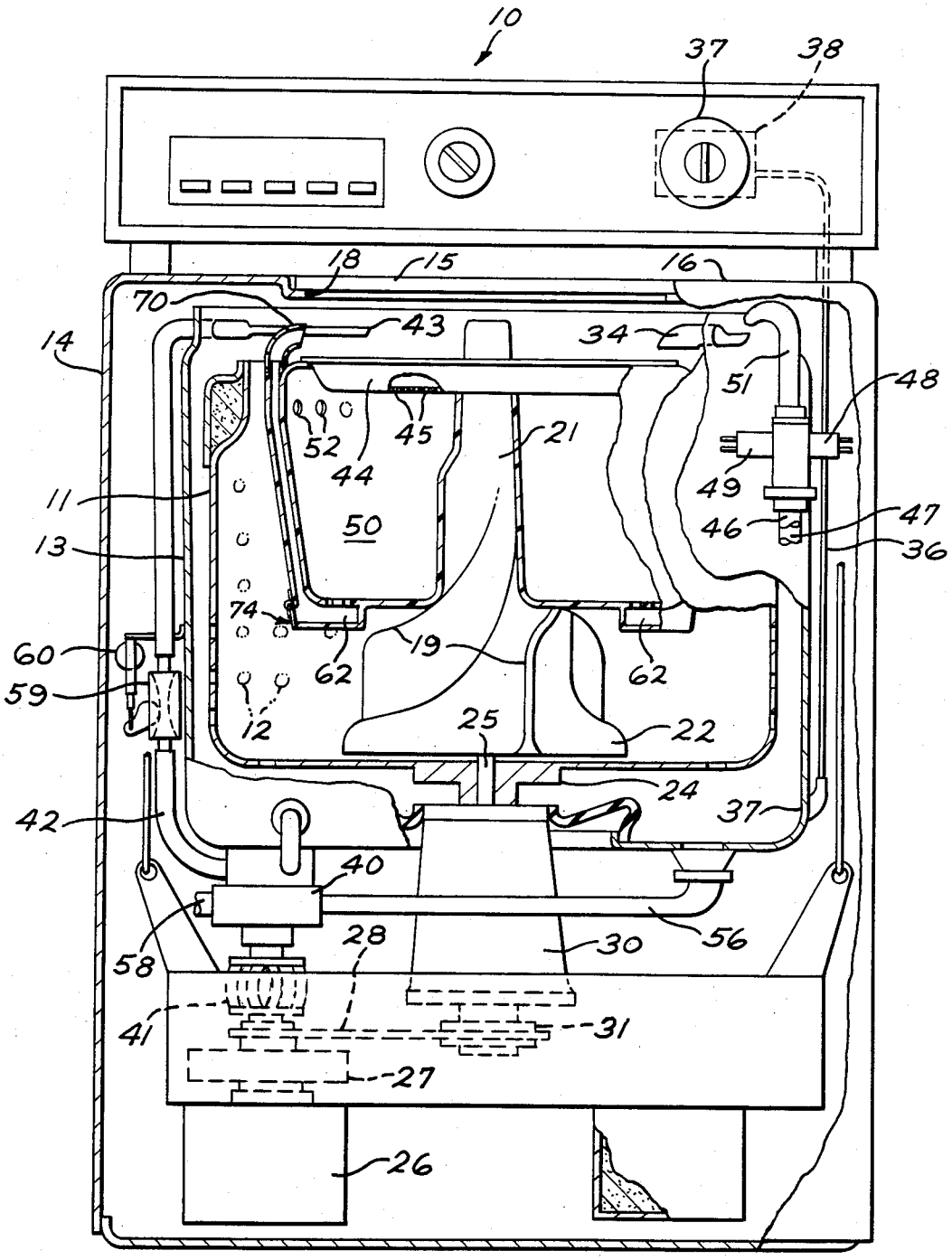
FIG. 1 is a front elevational view of a clothes washing machine incorporating the present invention, the view being partially broken away and partially in section to illustrate details.

Referring now to the drawings there is shown an agitator type clothes washing machine 10 having a conventional basket or clothes receiving receptacle 11 perforated over its side and bottom walls with perforations 12 and disposed within an outer imperforated tub 13. Tub 13 is mounted within an appearance cabinet 14 which includes a cover 15 hingedly mounted in the top portion 16 of the cabinet for providing access through an opening 18 to the basket 11. At the center of the basket 11 there is positioned a vertical axis agitator 20 which includes a center post 21 and a plurality of water circulating veins joined at their lower ends by an outwardly flared skirt 22.

Both the clothes basket 11 and the agitator 20 are rotatably mounted. The basket 11 is mounted on a flange of a rotatable hub 24 and the agitator is mounted on a shaft 25 which extends upwardly through the hub and through the center post 21 and is secured to the agitator so as to drive it. During the cycle of operation of the machine the agitator 20 is first oscillated back and forth on its axis, that is, in a horizontal plane within the basket 11 to wash the clothes therein. Then after a predetermined period of this washing action the basket 11 is rotated at a high speed to extract centrifugally the washing liquid from the clothes and discharge it to drain as will be explained. Following this extraction operation a supply of clean water is introduced into the basket for rinsing the clothes and the agitator is again oscillated. Finally, the basket is once more rotated in high speed to extract the rinse water.

The basket 11 and agitator 20 may be driven by any suitable means as the drive means forms no part of the present invention. However, by way of example they are shown driven from a reversible motor 26. The motor 26 drives the basket 11 and the agitator 20 through a drive including a clutch 27 which is mounted on the motor shaft. The clutch 27 allows the motor 26 to start within a load and then to accept the load as it comes up to speed. A suitable belt 28 transmits power to a transmission assembly 30 through a pulley 31. Thus, depending upon on direction of motor rotation the pulley 31 of the transmission is driven in opposite directions. Preferably, as will be more fully explained below, transmission clutch 27 is also a two-speed clutch. Specifically, in the illustrated machine the clutch 27 provides a direct drive between the motor 26 and the pulley 31 and a reduced speed drive to the pulley 31. The transmission 30 is so arranged that it supports and drives both the agitator drive shaft 25 and the basket mounting hub 24. When the motor 26 is rotated in one direction the transmission causes the agitator 20 to oscillate in a substantially horizontal plane within the basket 11. Conversely, when the motor 26 is driven in the opposite direction the transmission 30 rotates the wash basket 11 and agitator 20 together at high speed for centrifugal extraction. In order to introduce fresh water to the machine a suitable conduit 34 is provided having an outlet opening into the tub 13 so that suitable washing and rinsing liquid may be introduced in the desired quantities into the tub 13 and basket 11. It will at this point be noted that in the preferred construction shown the perforations 12 of the basket 11 cause the interior of the basket 11 to be in full communication with part of the tub 13 which is exterior to the basket 11 so that the liquid level in both the basket 11 and the tub 13 is the same. Thus, as the water rises in one it will also rise in the other. With this type of structure suitable means may thus be provided in the tub 13 to determine when the appropriate water level in the basket 11 has been reached. In the present case this structure is provided in a conventional manner by means of a tube 36 which extends from an opening 37 adjacent the bottom of the tub 13 up to a pressure sensitive water level control 38 which may be of the conventional type.

In effect, in this type of water level control an electric switch (not shown) is included in the device 38 and the switch is operated in response to an increase of the air within the conduit 36. The increase in air pressure coming as a result of compression of air by a rise in the level of water in the tub 13. A further conventional embodiment of level control is the provision of means for varying the point at which the switch is closed by the air pressure so that any one of several different air pressures may be selected for the closing of the switch. In this manner different levels within the tub may be selected by movement of dial 39 to different positions. In the present embodiment a 4-position control is employed. One position provides a level which substantially fills the basket 11, a second setting provides about two-thirds of a basket, a third setting shuts off the incoming water when it reaches about half the height of the basket, and the fourth lowest level which will be more fully discussed in connection with the present invention shuts off the incoming water when it reaches a very low level in the tub which may well not even rise to the bottom of the basket 11.

In the direction of rotation which is provided for the washing operations the motor 26 drives a pump 40 through a flexible coupling 41 in the appropriate direction to discharge liquid from the bottom of the tub 13 into a conduit 42 which leads to a nozzle 43. The nozzle 43 is positioned relative to a filtering member 44 secured on the top of the agitator 20 so as to be movable therewith so that liquid is recirculated by pump 40 hooked up through the conduit 42 and out of the nozzle 43 into the oscillating filter pan 44. It will be observed that the filter pan 44 has a substantial number of small openings 45 formed therein so that the water coming from the nozzle 43 passes down through the openings 45. The filter pan 44 with its many small openings and its upstanding side walls causes the lint, which is separated from the clothes during the washing operation, to be filtered out of the water and thus prevents it from being redeposited on the clothes.

Hot and cold water may be supplied to the machine through conduits 46 and 47 which are adapted to be connected respectively to sources of hot and cold water (not shown). Conduits 46 and 47 extend into a valve structure having solenoids 48 and 49 and being connected to a hose 51.

Also secured on the agitator so as to move therewith is a clothes containing basket 50 which is small relative to the basket 11 and the tub 13. The basket 50, except for overflow openings 52 adjacent the top thereof, is imperforate. The lower inner portion of the annular basket 50 may be formed to accommodate the tops of the vanes 19 of the agitator 20, in addition providing small washing vanes within the basket 50 itself. This positions the basket 50 securely on the agitator 20 so that there will not be any relative rotation of the two. The basket 50 is positioned below the filter pan 44 so that water which is poured into the filter pan from the nozzle 43 passes through the openings 45 in the filter pan 44 down into the basket 11. Thus, in effect the filter pan affects a filtering action of the water prior to its entry into the basket 11.

The filter pan 44 and basket 50 are preferably removably positioned on the agitator 20 so that they may be removed when so desired, for instance, for inserting clothes into the basket 11 and readily replaced on the agitator 20 secured thereto as to move therewith.

Completing the description of the structure, when enough washing has been provided and it is intended to remove the washing liquid from the clothes the direction of rotation of the motor is reversed. As described above, this causes the basket 11 and agitator 20 to rotate together at a relatively high speed so as to centrifuge the washing liquid out through the openings 12. The washing liquid thus removed is caused by the pump 40 rotating in the reverse direction to the previous rotation thereof to discharge into a conduit 56. The conduit 56 is adapted for discharge to a drain line 58 so that the pump 40 is effective to drain the tub 13.

As mentioned herein above, the control member 38 may be used to provide four different water levels in the tub 13, three of them being operative to provide water within the basket 11 and one of them being at such a low level within the tub 13 that there is insufficient water in the basket 11 to provide any washing action. This last low water level is provided when generally it is desired to use the small basket 50 to wash a very small load which generally occurs when delicate or heavily soiled garments of the type which constitute a small minority of all clothes worn must be washed and there is insufficient quantity to justify the use of the large basket 11.

In the present machine the small basket 50 is adapted to be used, as will be explained fully hereinafter, to wash a small quantity of clothes in a very high detergent concentration relative to the amount of water in the basket 50. In this instance the use of the small basket and a high concentration of detergent enhances the stain removal capability of the washing machine.

Use of the basket 50 and its cycle of operation in washing a normal small quantity of clothes will now be described. When such a load is to be washed the small basket 50 is placed on the agitator mechanism as shown and the filter pan 44 is then placed over the small basket 50.

When the lowest liquid level selected is reached in the basket and outer tub as described the motor 26 starts operation in the direction suitable for moving the agitator mechanism. As described this also causes the pump 40 to operate in the direction to pump water up through the conduit 42 and out from the nozzle 43 into the filter pan 45. This water then passes through the openings 45 in the filter pan 45 down into the basket 50 containing a small quantity of clothes. Because the basket 50 is substantially imperforate the water quickly rises in the basket regardless of the fact that the basket 11 does not have any water or virtually no water in it. The water continues to rise in the basket 50 until it reaches substantially to the level of the overflow outlets 52.

As mentioned above, provision is made to employ the small basket 50 to wash a small quantity of clothes having a heavy soil concentration in a relatively small volume of water. This enables the user to establish a high concentration of detergent while using a relatively small volume of water and detergent. To this end, circulation of liquid to the basket 50 is terminted once the liquid level reaches the overflow apertures 52. At this point in time, because of the relatively small volume of water in the basket 50 the clothes can readily be washed in a high concentration of detergent during a heavy soil removal cycle of operation while using reasonable amounts of detergent. To this end, a pinch valve 59 is provided which is operated by a solenoid 60 arranged in conduit 42. The solenoid 60 is energized to cut recirculation flow to the basket 50 after a predetermined amount of time. In carrying out the operation of washing clothes in the small volume of water in basket 5, the solenoid is activated to cut of the flow of water to basket 50 after 30 seconds which time was found appropriate to transfer a volume of water from tub 13 sufficient to fill the basket 50.

In the lowest water level selection the water volume in the outer tub and basket is greater than needed to fill the small basket 50. While it might result in using less water by filling the small basket directly, controlling the temperature of the wash water would be difficult if not impossible. This is especially true in selecting a hot water wash since the initial flow would normally be cold until the lines are purged. Because of the relatively small volume of water required to fill the small basket it will, in most instances, fill with cold water before the supply line is purged and the hot water reaches the basket 50.

Accordingly, this problem is eliminated by first filling the outer tub and basket in the normal manner. This volume of water even at the lowest water setting is sufficient to purge the hot water supply line of cold water and still provide adequate hot water for the wash cycle.

In the machine thus far described the small basket 50 provides means for isolating and confining a limited water volume in the range from 1.0 to 2.5 gallons during the activation or wash cycle of operation. This ability to confine a limited water volume in the wash cycle of operation allows for the attainment of very high detergent concentrations in the range from 0.8 to 3.3 weight percent based on the usage of reasonable and acceptable amount of detergent in the range from 75 to 125 grams. The high concentration of detergent achieved together with the agitation provided during the wash cycle of operation have been found to enhance washing performance significally. By way of comparison, these detergent concentrations were 8 to 33 times that commonly achieved in washing clothes in the larger clothes basket.

As thus far described the machine is fully disclosed in co-pending application designated 90-HL-16624-McMillan et al assigned to the General Electric Company the assignee of the present application. It is apparent that the ability to employ a high detergent concentration in the present machine is made possible by allowing the recirculation system to fill the small basket 50 and to then terminate recirculation flow so that the clothes are washed in this limited amount of water. While this provides an effective high detergent concentration wash operation, it nevertheless by disabling the recirculation system stops the filtering function of the filter pan 40 during this initial wash cycle period.

By the present invention means are provided in conjunction with the above described clothes washing machine to insure that a filtering system is operational during the initial washing cycle when the flow through conduit 42 is cut off and the clothes are being washed in the basket 50. The means includes a secondary recirculating system whereby the small volume of water in the basket 50 is recirculated therethrough independent of the primary recirculation system thus far described.

With reference to FIG. 2, the bottom wall 60 of the basket 50 is formed to include a plurality of sump areas 62. The exact number of sump areas provided is not critical in carrying out the present invention, however, it is necessary that they be arranged so as to maintain a proper balance of the basket 50 during the high speed centrifugal extraction cycle. The sump areas 62 as will be described hereinafter are in effect sediment traps. Positioned in the outer radial portion of each sump area 62 is an outlet 64. Recirculating conduits 66 are connected so as to communicate at one end with the outlet 64. The conduits 66 as shown are formed as part of the basket 50 and extend upwardly along the side wall 67 of the basket 50. The conduits 66 terminate at their upper end in an outlet 68 extending above the upper end of the basket side wall 67. Positioned on the outlet 68 of conduit 66 is a deflecting member 70 which is dimensioned to divert water exiting the conduit 66 into the filter pan 44 as shown by directional arrows 72. During the washing cycle the turbulence of the water generated by the oscillation of the basket 50 causes a portion of the water in the lower extremities of the basket 50 to be pumped up through the conduits 66 and into the filter pan 44 where it flows through opening 45 to reenter the basket 50. This pumping action of water through the conduits 66 provides a continuing recirculation of water in the basket 50 during the washing action of the machine. The number and size of the conduits 66 are selected to insure that the amount of water recirculated through the conduits is sufficient to provide an effective filtering of lint and other water-bourne debris from the clothes.

While the recirculation of water through the basket 50 is referred to as a secondary recirculation system, it should be noted that the present system may be employed in a washing machine not having a primary recirculation system. In which instance the system as taught by the present invention would function as a recirculating lint removal system for the small gasket.

During the agitation process of the washing action, heavy dirt particles dislodged from the clothing by the oscillating action of the agitator fall by gravity to the bottom wall 60 of the basket 50. As mentioned above means are also provided by the present invention to insure the removal of sediments from the wash water in basket 50. The movement of the water within the basket 50 directs the sediment into the sump areas 62 as indicated by arrows 72 where the unwanted material remains during the balance of the washing operation. Arranged in the radial end of each sump area 62 is a centrifugal valve shown generally at 74. The exact structure of the valve 74 is not critical in carrying out the present invention other than it opens when the basket 50 is rotated during its high speed extraction cycle. During the following high-speed extraction cycle the centrifugal valve 74 opens as shown in broken lines in FIG. 2 to expose a port 76 so that sediment collected in the sump area 62 passes through port 76 to the clothes receptacle 11. Upon termination of the rotation of the spinning basket 50 during the extraction cycle, the valve 74 automatically reseats itself into liquid retaining engagement with the port 76.

Referring now to FIG. 3 in order to insure the sediment which flows into the sump areas 62 is retained therein there is provided a sump cover member 80. The cover member 80 includes an opening 82 having a downwardly circumferentially disposed lip 84. The downwardly extending lip 84 in conjunction with the sump area 62 acts as a trap to prevent sediment from returning to the basket 50 during the turbulent washing action.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A vertical axis clothes washing machine having wash, rinse, and centrifugal extraction operations comprising:

liquid and clothes containing means including a relatively large substantially imperforate outer receptacle, and a relatively large perforated clothes receptacle positioned within said receptacle;

an agitator extending upwardly into said clothes receptacle;

means for rotating said clothes receptacle and said agitator at a relatively high speed during said centrifugal extraction operation;

means for effecting a washing motion of said agitator;

water inlet means for providing fresh water to said liquid and clothes containing means;

a control system including manually settable means for terminating the flow of water from said inlet means and for starting said means for effecting said washing motion of said agitator and said extraction operation;

a relatively small substantially imperforate basket positioned on said agitator and movable therewith;

a perforated filter pan mounted on said agitator covering substantially the entire top of said imperforate basket;

means being manually settable to provide a relatively high level of water when clothes are to be washed in said clothes receptacle and settable to a relatively low water level when clothes are to be washed in said basket;

a liquid recirculation means including a conduit connected between an inlet in said outer receptacle and an outlet means positioned for supplying water to said basket, pumping means arranged to pump liquid from said outer receptacle through said outlet means;

recirculating water control means including valve means in said conduit operable for terminating the flow of water to said outlet means after a predetermined amount of time so that clothes contained in said basket are washed in the selected volume of water independent of the volume of water in said receptacles; and a secondary recirculation means including a conduit connected between an inlet in the lower portion of said imperforate basket and an outlet means positioned for supplying water through said filter pan to said basket whereby said washing motion of said agitator causes water to be pumped through said conduit independent of said liquid recirculation means.

2. The clothes washing machine recited in claim 1 wherein said imperforate basket is provided with a sump area communicating with the bottom wall of said basket and said inlet end of said conduit is connected to said sump area.

3. The clothes washing machine recited in claim 2 wherein said sump area includes an outlet having a centrifugal valve arranged therein whereby sediment in said sump area is centrifugally ejected during said centrifugal extraction operation.

* * * * *